US012540768B2

(12) United States Patent
Vijayan et al.

(10) Patent No.: US 12,540,768 B2
(45) Date of Patent: Feb. 3, 2026

(54) INFUSED ICE MAKER APPLIANCE

(71) Applicant: Haier US Appliance Solutions, Inc., Wilmington, DE (US)

(72) Inventors: Vineeth Vijayan, Louisville, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 55 days.

(21) Appl. No.: 18/632,017

(22) Filed: Apr. 10, 2024

(65) Prior Publication Data

US 2025/0321039 A1 Oct. 16, 2025

(51) Int. Cl.
*F25C 1/25* (2018.01)

(52) U.S. Cl.
CPC ..... *F25C 1/25* (2018.01)

(58) Field of Classification Search
CPC ..... F25C 1/25; F25C 5/06; F25C 2400/10; F25C 1/22–1/243; F25C 2305/0221; A23G 9/083; A23G 9/045
See application file for complete search history.

(56) References Cited

U.S. PATENT DOCUMENTS

| | | | |
|---|---|---|---|
| 2,237,525 | A | 4/1941 | Nolan |
| 2,918,803 | A | 12/1959 | Bauerlein et al. |
| 6,513,337 | B1 | 2/2003 | Astvatsatrian et al. |
| 6,513,578 | B2 | 2/2003 | Frank |
| 6,672,097 | B1 | 1/2004 | Ashley |
| 8,794,126 | B2 | 8/2014 | Skalski et al. |
| 9,038,410 | B2 | 5/2015 | Erbs et al. |
| 9,066,529 | B2 | 6/2015 | Fassberg et al. |
| 9,759,470 | B2 | 9/2017 | Zisholtz et al. |
| 10,378,806 | B2 | 8/2019 | Boarman et al. |
| 2006/0254300 | A1 | 11/2006 | Rugeris |
| 2009/0120306 | A1 | 5/2009 | DeCarlo et al. |
| 2016/0205988 | A1 | 7/2016 | Bird et al. |
| 2016/0216020 | A1 | 7/2016 | Safrin |
| 2017/0042181 | A1 | 2/2017 | Fiaschi |

FOREIGN PATENT DOCUMENTS

| | | | |
|---|---|---|---|
| CN | 101871711 | B | 8/2012 |
| CN | 102297551 | B | 4/2013 |
| CN | 110906645 | A | 3/2020 |
| DE | 20218085 | U1 | 2/2003 |

*Primary Examiner* — Cassey D Bauer
(74) *Attorney, Agent, or Firm* — Dority & Manning, P.A.

(57) ABSTRACT

An ice maker appliance includes an additive receiver chamber. The additive receiver chamber includes a plurality of chamber walls and an enclosed internal volume defined therein. The ice maker appliance also includes an additive cup positioned within the additive receiver chamber. The additive cup is configured to receive a volume of liquid additive. A dispensing tube coupled to the additive cup extends partially within the additive receiver chamber. The ice maker appliance also includes a fill tube in fluid communication with a water supply and a mold body comprising a mold cavity. The mold cavity is configured for receiving a mixture of liquid water from the fill tube and liquid additive from the additive cup through the dispensing tube and for retaining the mixture of liquid water and liquid additive to form an ice piece from the mixture in the mold cavity.

18 Claims, 8 Drawing Sheets

INFUSED ICE MAKER APPLIANCE

FIELD OF THE INVENTION

The present subject matter relates generally to ice maker appliances, and in particular to ice maker appliances configured to produce infused ice from water and an additive such as a flavorant, e.g., ice that is infused with one or more additives.

BACKGROUND OF THE INVENTION

Certain refrigerator appliances include an ice maker. An ice maker appliance may also be a stand-alone appliance designed for use in commercial and/or residential settings. To produce ice, liquid water is directed to the ice maker and frozen. For example, certain ice makers include a mold body for receiving liquid water. In some systems, a working fluid is used to directly cool the mold body, e.g., by conductive heat transfer. In other systems, the air around the mold body may be cooled such that the mold body is indirectly cooled via the air. When the mold body is cooled, directly and/or indirectly, ice may be formed from the liquid water therein. After ice is formed in the mold body, it may be harvested from the mold body and stored within an ice bin or bucket within the refrigerator appliance.

Conventional ice maker appliances are configured for producing ice pieces solely from water, e.g., tap water or water from other similar sources. Thus, the resulting ice from such ice maker appliances may be perceived as bland and generally provides little to no flavor or nutrients. Thus, there is a desire for ice maker appliances which can produce enhanced ice, e.g., ice infused with a flavorant or other additive. Typical ice maker appliances provide a very cold environment in order to promote more rapid ice formation, however, such very cold temperatures may create difficulties in forming infused ice, such as may cause the additive to thicken (increase viscosity) or freeze and thus inhibit the ability to flow the additive.

Accordingly, an ice maker with features for producing infused ice from water and an additive, such as a flavorant, electrolytes, vitamins, and/or other similar additives, would be desirable.

BRIEF DESCRIPTION OF THE INVENTION

Aspects and advantages of the invention will be set forth in part in the following description, or may be apparent from the description, or may be learned through practice of the invention.

According to an exemplary embodiment, an ice maker appliance is provided. The ice maker appliance includes an additive receiver chamber. The additive receiver chamber includes a plurality of chamber walls and an enclosed internal volume defined within the plurality of chamber walls. The ice maker appliance also includes an additive cup positioned within the additive receiver chamber. The additive cup is configured to receive a volume of liquid additive. The ice maker appliance further includes a dispensing tube coupled to the additive cup. The dispensing tube extends partially within the additive receiver chamber. The ice maker appliance also includes a fill tube in fluid communication with a water supply and a mold body comprising a mold cavity. The mold body is positioned downstream of the dispensing tube and the fill tube. The mold cavity is configured for receiving a mixture of liquid water from the fill tube and liquid additive from the additive cup through the dispensing tube and the mold cavity is further configured for retaining the mixture of liquid water and liquid additive to form an ice piece from the mixture in the mold cavity.

According to another exemplary embodiment, a refrigerator appliance is provided. The refrigerator appliance includes a cabinet with a chilled chamber defined within the cabinet. The refrigerator appliance further includes an ice making assembly. The ice making assembly includes an additive receiver chamber. The additive receiver chamber includes a plurality of chamber walls and an enclosed internal volume defined within the plurality of chamber walls. The ice making assembly also includes an additive cup positioned within the additive receiver chamber. The additive cup is configured to receive a volume of liquid additive. The ice making assembly further includes a dispensing tube coupled to the additive cup. The dispensing tube extends partially within the additive receiver chamber. The ice making assembly also includes a fill tube in fluid communication with a water supply and a mold body comprising a mold cavity. The mold body is positioned downstream of the dispensing tube and the fill tube. The mold cavity is configured for receiving a mixture of liquid water from the fill tube and liquid additive from the additive cup through the dispensing tube and the mold cavity is further configured for retaining the mixture of liquid water and liquid additive to form an ice piece from the mixture in the mold cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
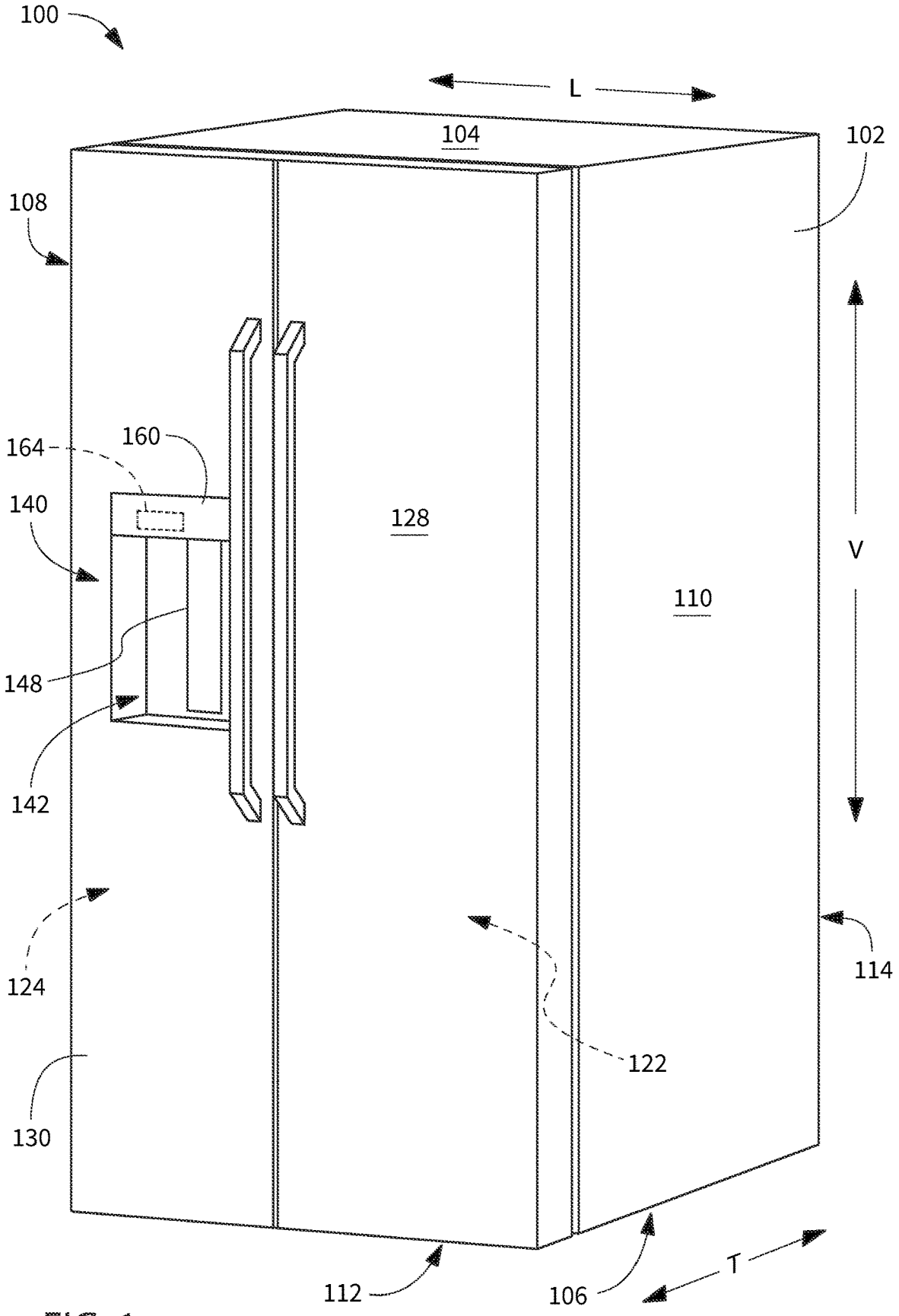
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise. As used herein, the terms "first," "second," and "third" may be used interchangeably to distinguish one component from another and are not intended to signify location or importance of the individual components.

Furthermore, the skilled artisan will recognize the interchangeability of various features from different embodiments. Similarly, the various method steps and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent a right side (e.g., second side 110) of housing 102 and a freezer chamber 124 arranged at or adjacent a left side (e.g., first side 108) of housing 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance, a bottom mount refrigerator appliance, or a single door refrigerator appliance (such as a refrigerator appliance with a single chilled chamber therein, e.g., a standalone freezer or standalone refrigerator appliance, such as a columns unit). Consequently, the description set forth herein is for illustrative purposes only and is not intended to be limiting in any aspect to any particular refrigerator chamber configuration.

Refrigerator door 128 is rotatably hinged to an edge of housing 102 for selectively accessing fresh food chamber 122. In addition, a freezer door 130 is arranged opposite refrigerator door 128 for selectively accessing freezer chamber 124. Refrigerator door 128 and freezer door 130 are shown in the closed configuration in FIG. 1. One skilled in the art will appreciate that other chamber and door configurations are possible and within the scope of the present invention.

Referring still to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of the doors, e.g., freezer door 130. In this regard, dispenser recess 142 is defined on front side 112 of refrigerator appliance 100 such that a user may operate dispensing assembly 140 without opening freezer door 130. In addition, dispenser recess 142 is positioned at a predetermined elevation convenient for a user to access ice and enabling the user to access ice without the need to bend over. In the exemplary embodiment, dispenser recess 142 is positioned at a level that approximates the chest level of a user.

Dispensing assembly 140 includes an ice dispenser including a discharging outlet for discharging ice from dispensing assembly 140. An actuating mechanism 148, shown as a paddle, is mounted below discharging outlet for operating an ice or water dispenser. In alternative exemplary embodiments, any suitable actuating mechanism may be used to operate the dispenser. For example, the dispenser may include a sensor (such as an ultrasonic sensor) or a button rather than the paddle. The discharging outlet and the actuating mechanism 148 are an external part of the ice and/or water dispenser and are mounted in dispenser recess 142.

Returning again to FIG. 1, a control panel 160 is provided for controlling the mode of operation. For example, control panel 160 may include one or more selector inputs (not shown), such as knobs, buttons, touchscreen interfaces, etc., such as a water dispensing button and an ice-dispensing button, for selecting a desired mode of operation such as crushed or non-crushed ice. In addition, the selector inputs may be used to specify a fill volume or method of operating dispensing assembly 140. In this regard, the selector inputs may be in communication with a processing device or controller 164. Signals generated in controller 164 operate refrigerator appliance 100 and dispensing assembly 140 in response to selector inputs. Additionally, a display, such as an indicator light or a screen, may be provided on control panel 160. The display may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions and/or data that when executed by the processing device, cause the processing device to perform operations. For example, the instructions may include a software package configured to operate the system to, e.g., execute the exemplary methods described below. In exemplary embodiments, the various method steps as disclosed herein may be performed, e.g., in whole or part, by controller 164 and/or another, separate, dedicated controller.

Figure 2:
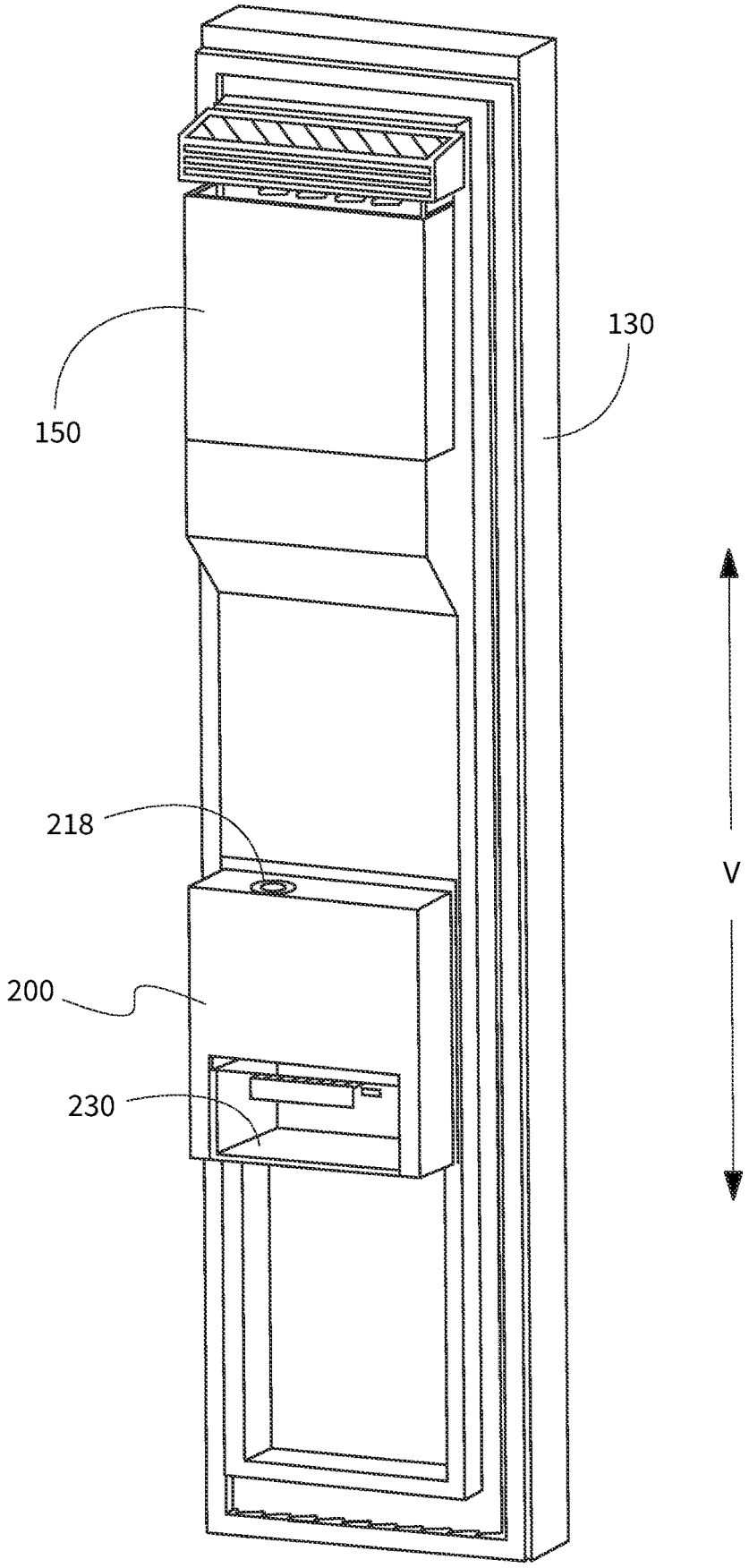
FIG. 2 provides a perspective view of an internal side of an exemplary door for a refrigerator appliance such as the exemplary refrigerator appliance of FIG. 1.
Figure 3:
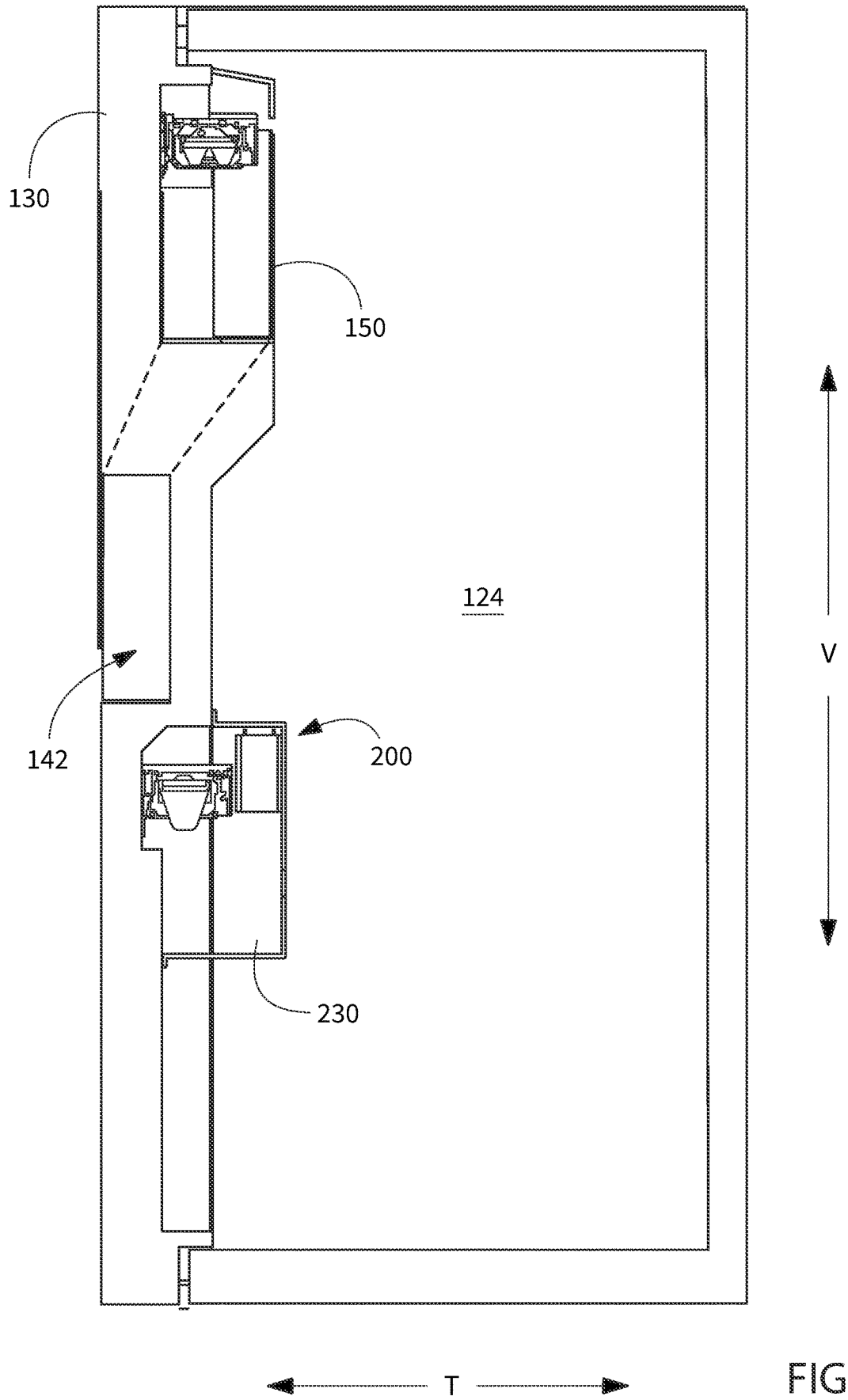
FIG. 3 provides a section view of the exemplary refrigerator appliance of FIG. 1.

Turning now to FIG. 2, an inner side of freezer door 130 is illustrated. FIG. 3 illustrates a section through the exemplary refrigerator appliance 100 at the freezer chamber 124. As may be seen in FIGS. 2 and 3, an icebox 150 may be defined on the inner side of the freezer door 130. Thus, as shown, e.g., in FIG. 3, the icebox 150 may be disposed within the freezer chamber 124 when the freezer door 130 is in the closed position. The icebox 150 may house an ice maker, which may be a primary ice maker of the refrigerator appliance and which may be configured to supply ice to dispenser recess 142. In this regard, for example, icebox 150 may define an ice making chamber for housing ice maker (e.g., a first or primary ice maker configured for making water ice or plain ice), a storage mechanism, and a dispensing mechanism.

Refrigerator appliance 100 may further include a second ice maker 200 (sometimes also referred to as an ice making assembly 200), such as may be configured for making infused ice, e.g., flavored ice. For example, when the first or primary ice maker configured for making water ice or plain ice is provided, the second ice maker 200 which makes infused ice may be a specialty or auxiliary ice maker. As may be seen in FIGS. 2 and 3, ice making assembly 200 may be defined on the inner side of the freezer door 130, such that the ice making assembly 200 may be disposed within the freezer chamber 124 when the freezer door 130 is in the closed position. The ice maker 200 is generally configured for freezing liquid water mixed with an additive to form the infused ice, e.g., infused ice pieces such as ice cubes. For example, the ice maker 200 may include one or more mold cavities 226 (see, e.g., FIGS. 4 through 6) defined therein, such as in a mold body 220 thereof, and the liquid water and additive may be directed into the mold cavity (or cavities) 226 of the ice maker 200. The liquid water and additive may be mixed together while flowing to the mold body 220 and/or may mix in the mold body 220, and the mixed liquid may then be retained in the mold body at a temperature at or below the freezing point of water to form an ice piece or ice pieces. Such ice pieces may be harvested from the mold body 220 and stored in an ice bin 230, e.g., below the mold body 220 such that the ice bin 230 may receive the infused ice pieces from the mold body 220 by gravity.

As mentioned above, the present disclosure may also be applied to other types and styles of refrigerator appliances such as, e.g., a top mount refrigerator appliance, a bottom mount refrigerator appliance, or may be applied to a standalone ice maker appliance. Variations and modifications may be made to ice making assembly while remaining within the scope of the present subject matter.

Accordingly, the description herein of the icebox 150 and ice maker 200 on the door 130 of the freezer chamber 124 is by way of example only. In other example embodiments, the ice making assembly or ice maker 200 may be positioned in the fresh food chamber 122, e.g., of the illustrated side by side refrigerator, of a bottom-mount refrigerator, of a top-mount refrigerator, or any other suitable refrigerator appliance. As another example, the ice making assembly 200 may also be provided in a standalone ice maker appliance and/or may be the only ice making assembly in the ice maker appliance. As used herein, the term "standalone ice maker appliance" refers to an appliance of which the sole or primary operation is generating or producing ice, e.g., without any additional or other chilled chambers, whereas the more general term "ice maker appliance" includes such appliances as well as appliances with diverse capabilities in addition to making ice, such as a refrigerator appliance equipped with an ice maker, among other possible examples.

In some embodiments, the ice maker 200 may include a dedicated controller, e.g., similar to the controller 164 of the refrigerator appliance 100 which is described above. In embodiments where the ice maker 200 is incorporated into a refrigerator appliance such as the exemplary refrigerator appliance 100 described hereinabove, the dedicated controller may be in addition to the controller 164 of the refrigerator appliance and may be in communication with the controller 164 of the refrigerator appliance 100, and the controller of the ice maker 200 may be in operative communication with other components of the ice maker 200 and may be configured specifically for controlling or directing operation of such components.

Figure 4:
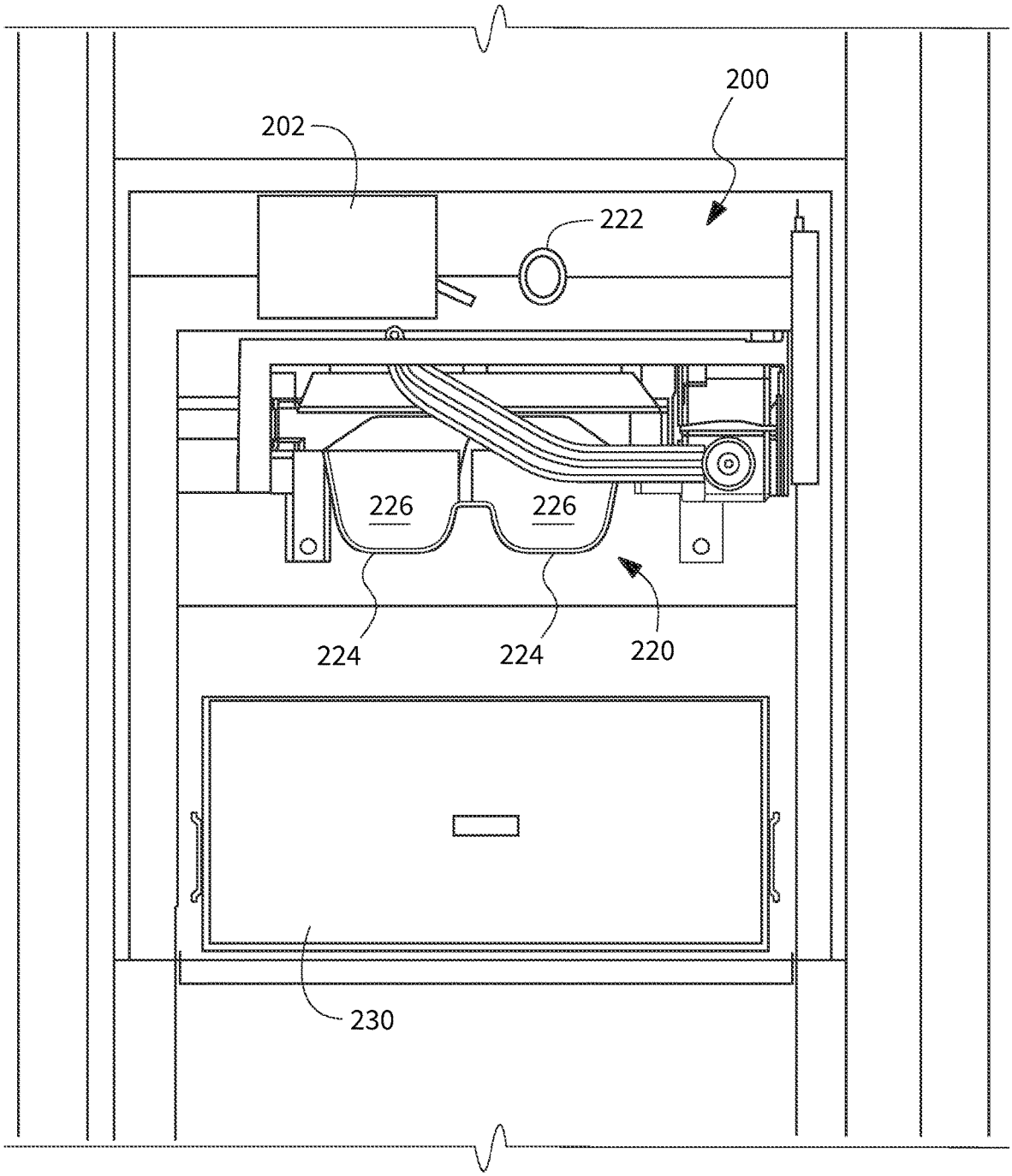
FIG. 4 provides an elevation view of an ice making assembly for an ice maker appliance, such as the exemplary refrigerator appliance of FIG. 1.
Figure 5:
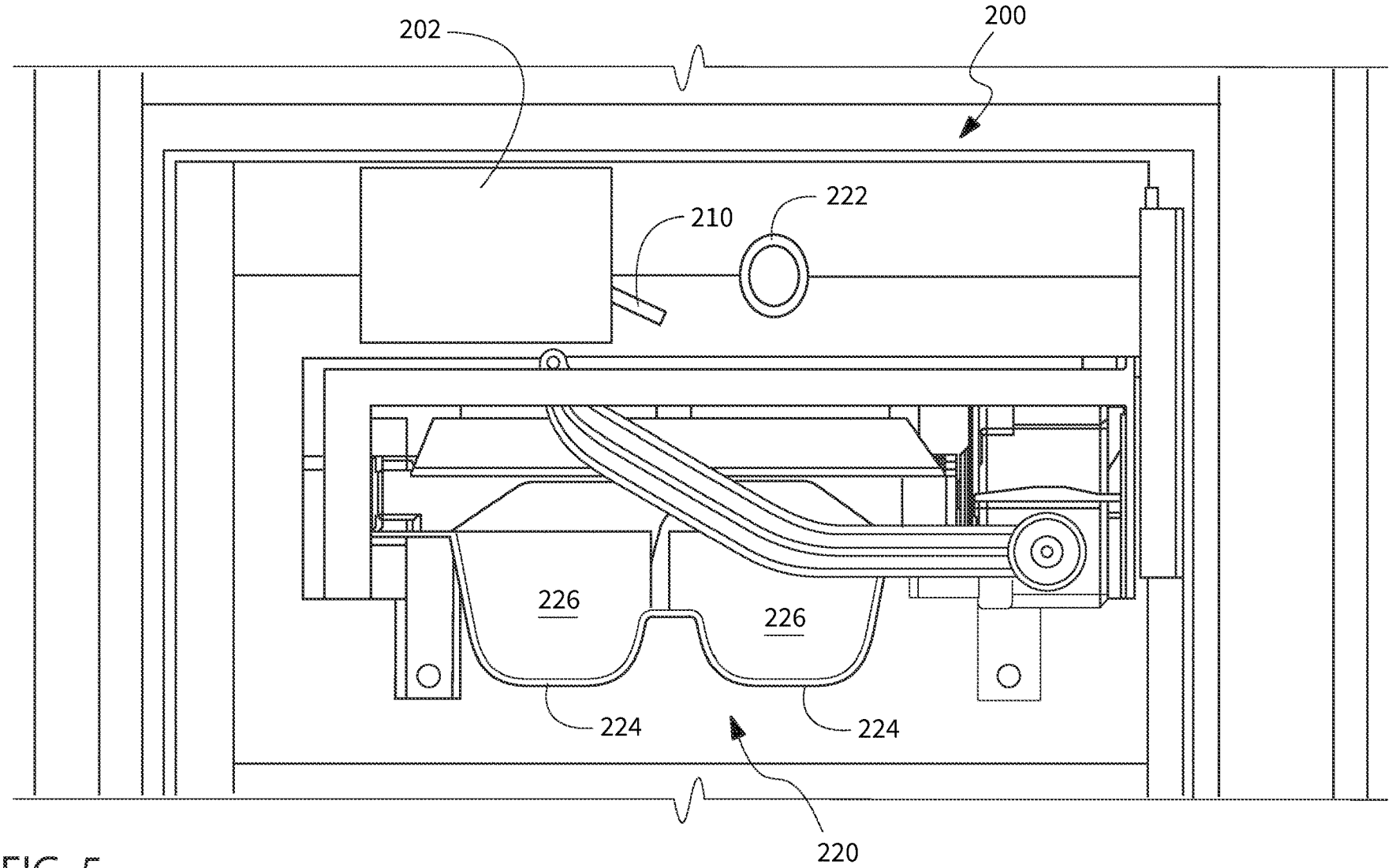
FIG. 5 provides an enlarged elevation view of the exemplary ice making assembly of FIG. 4.

Referring now to FIGS. 4 and 5, elevation views of an exemplary embodiment of the ice maker 200 are illustrated. In some embodiments, e.g., as illustrated in FIG. 4, the ice maker 200 may include an additive receiver chamber 202. As may be seen in FIGS. 4 and 5, a dispensing tube 210 may extend from the additive receiver chamber 202 to provide a flow of additive from the additive receiver chamber 202, as will be discussed further below. The ice maker 200 may further include a water fill tube 222, e.g., which is coupled to a water supply to provide plain water (e.g., tap water such as from a municipal water system, well, or other similar source of potable water, such that "plain water" is intended to refer to typical drinking water as is understood by those of ordinary skill in the art). The mold body 220 may be downstream of, e.g., below, the additive dispensing tube 210 and the water fill tube 222, such that the mold body 220 receives both water and additive in order to form infused ice from both the liquid water and the additive in the mold body 220.

As may be seen, e.g., in FIGS. 4 and 5, the mold body 220 of the ice maker 200 may include one or more compartments 224 which define mold cavities 226 for receiving liquid therein, and the liquid may be retained within the compartment(s) 224 until ice is formed, e.g., liquid water mixed with additive may be retained in the mold body 220, and the liquid water mixed with additive may be held in the mold cavity 226 and cooled until the mixture freezes, thereby forming one or more enhanced or infused ice pieces, e.g., comprising both water and the additive.

Figure 6:
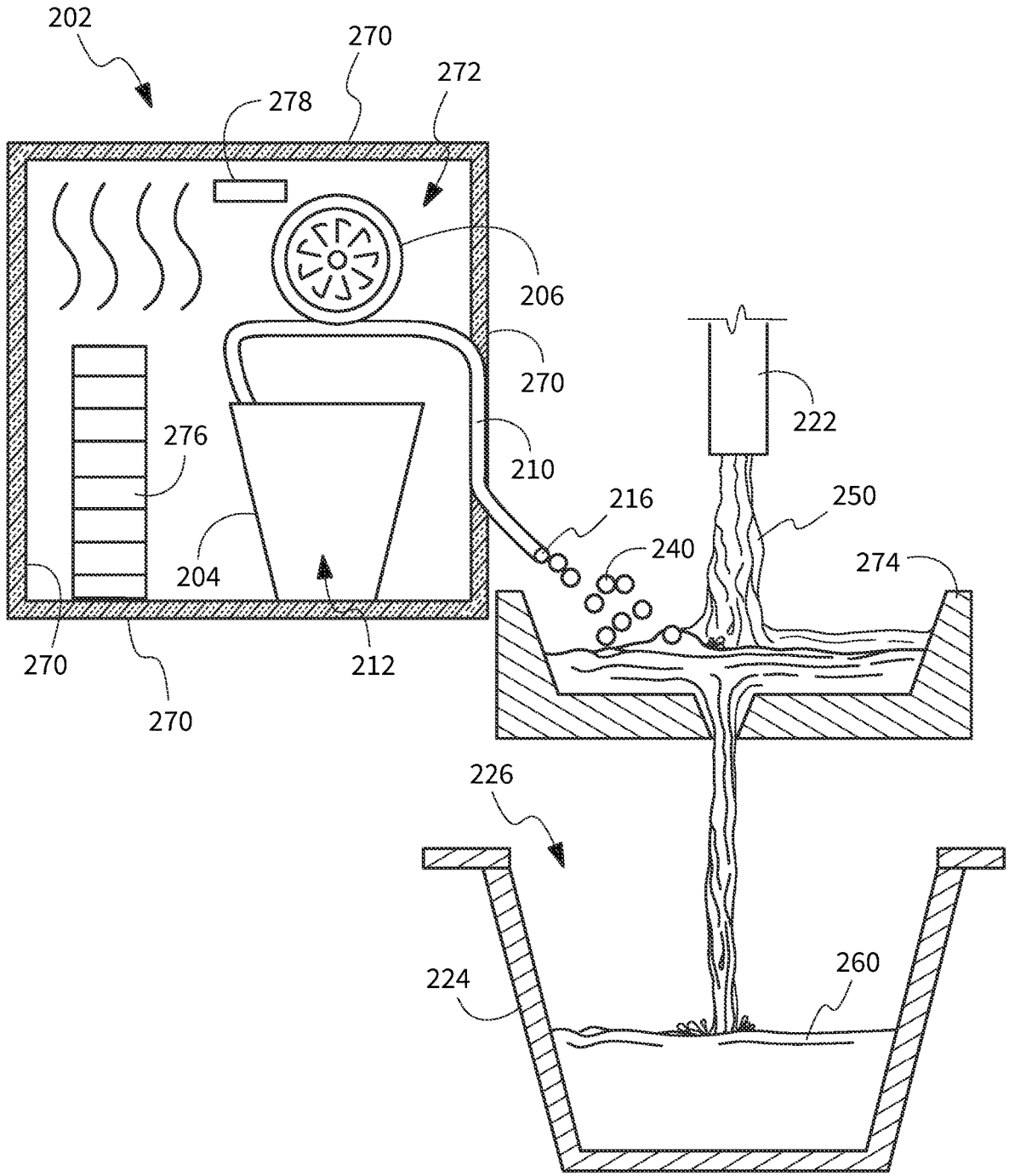
FIG. 6 provides a schematic illustration of the exemplary ice making assembly of FIG. 4 in a dosing operation.

Referring now to FIG. 6, the additive receiver chamber 202 may include a plurality of chamber walls 270 with an enclosed internal volume 272 defined within the plurality of chamber walls 270. For example, the plurality of chamber walls 270 may include six chamber walls 270, e.g., a top wall, a bottom wall, a front wall, a back wall, a left side wall, and a right side wall, such that one chamber wall 270 is positioned at each side of the enclosed internal volume 272, thereby fully enclosing the internal volume 272. A lid or door 218 (FIG. 2) may be provided in and through one of the chamber walls 270, providing access to the internal volume 272, e.g., for adding, replacing, or removing additive from the additive receiver chamber 202, such as a pod, cup, or other vessel containing the additive or by providing the additive directly to the additive chamber 202, as will be described further below. As illustrated in FIG. 6, the plurality of chamber walls 270 may be thermally insulated, e.g., to promote a temperature difference between the internal volume 272 and the surrounding area within the chilled chamber, e.g., the internal volume 272 of the additive receiver chamber 202 may be warmer than the surrounding area.

As may be seen in FIG. 6, components of the additive dispensing assembly may be positioned in the additive receiver chamber 202, e.g., an additive cup 204 and a dosing pump 206 connected to the additive cup 204 may be positioned within the additive receiver chamber 202, and the dispensing tube 210 may extend at least partially within the additive receiver chamber 202, such as the majority of the dispensing tube 210 may extend within the additive receiver chamber 202. The dispensing tube 210 may be downstream of the additive cup 204, such that a flow of additive from the additive cup 204 may be urged by the dosing pump 206 to the mold body 220 via the dispensing tube 210. For example, the dispensing tube 210 may extend from an inlet of the dispensing tube 210 coupled to the additive cup 204 to an outlet 216 (FIG. 6) of the dispensing tube 210.

The additive cup 204 may define an internal volume 212 which is sized and configured to hold a volume of liquid additive, such as a volume that is, in proportion to the total volume of the mold cavity (or cavities) 226, sufficient for mixing with a volume of water to form infused ice pieces in the mold cavity 226. In some embodiments, the liquid additive may be poured directly into the additive cup 204. In additional embodiments, the additive cup 204 may also be sized and configured to hold a vessel, e.g., pod, containing the volume of liquid additive therein as well as or instead of liquid added directly into the additive cup 204 (e.g., the internal volume 212 may be sized and configured to alternately receive liquid directly therein for one batch of enhanced ice and to receive a vessel therein for another batch of enhanced ice). Thus, the additive cup 204 may be configured to hold an additive, such as a liquid additive, for mixing with liquid water as the liquid water flows from a fill tube 222 of the ice maker 200.

The additive may be provided to and stored in the additive cup 204 in a liquid state, and may remain in the liquid state at least until the additive mixes with liquid water. Thus, for example, the additive receiver chamber 202 may be heated, e.g., to a temperature greater than the chilled chamber, e.g., freezer chamber 124, in which the additive receiver chamber 202 is disposed, in order to prevent the additive from freezing and to maintain a suitable viscosity in the liquid additive such that the additive may be readily pumped from the additive cup 204 (e.g., as urged by the dosing pump 206) and through the dispensing tube 210. Further by way of example, the chilled chamber, e.g., freezer chamber 124, may be operable as low as six degrees below zero Fahrenheit (−6° F.), and the additive receiver chamber 202 may be heated to at least zero degrees Fahrenheit (0° F.), such that the additive remains liquid and the viscosity of the additive remains low enough to be suitable for pumping. For example, the chilled chamber may be turned down to the lowest temperature within the operating range thereof, e.g., −6° F., at the beginning of an ice making cycle or ice making operation in order to promote faster ice formation. As will be described further below, in at least some embodiments, the additive receiver chamber 202 may be heated during such time in order to maintain a higher temperature therein and reduce or prevent the liquid additive from freezing or increasing in viscosity.

As illustrated in FIG. 6, the additive receiver chamber 202 may be heated by a heater 276 positioned within the internal volume 272 of the additive receiver chamber 202. Any suitable heater may be provided, such as heater 276 may be a DC heater, for example. Thus, when the heater 276 is activated, the internal volume 272 of the additive receiver chamber 202 may be brought to or maintained at a temperature greater than the prevailing temperature in the chilled chamber, e.g., freezer chamber, in which the ice maker 200 is located.

For example, the heater 276 may be activated prior to a dosing cycle or dosing operation, e.g., prior to activating the dosing pump 206, such as at a time "t" before the dosing cycle. In some embodiments, the dosing cycle may be predicted (e.g., by a dedicated controller of the ice maker 200 and/or a controller such as controller 164 of the refrigerator appliance in embodiments where the ice making assembly is provided in a refrigerator appliance) and the heater 276 may be activated in anticipation of a predicted dosing cycle. For example, a controller of the ice maker 200 and/or of the refrigerator appliance 100 may be operable to turn the heater 276 on at a predefined amount of time before turning the dosing pump 206 on. In such embodiments, the heater 276 may remain on throughout the dosing cycle, e.g., until sufficient additive for the current batch of enhanced ice has been dispensed and the dosing pump 206 is turned off.

In additional embodiments, the heater 276 may be activated intermittently as needed to maintain a predetermined constant temperature or temperature range within the internal volume 272 of the additive receiver chamber 202. For example, a temperature sensor 278, e.g., a thermistor or other suitable temperature sensor, may be provided in the additive receiver chamber 202. Thus, the heater 276 may be activated in response to a measured temperature from the temperature sensor 278, such as when the measured temperature reaches a predetermined minimum temperature level or maximum offset from (below) the desired constant temperature. The constant temperature may be any temperature suitable for maintaining the additive in a liquid state and keeping the viscosity of the additive low enough to be suitable for pumping and mixing. In some embodiments, the constant temperature maintained in the additive receiver chamber 202 may, for example, be at least 0° F., such as between 0° F. and about 30° F., such as between about 10° F. and about 15° F., such as between 0° F. and about 10° F., such as between 0° F. and about 5° F., such as 0° F., such as about 2° F. or about 3° F.

As mentioned, the dispensing tube 210 may be predominantly within the additive receiver chamber 202, with only an end portion of the dispensing tube 210 extending outside of the additive receiver chamber 202. The end portion of the dispensing tube 210 may be oriented generally downward along the vertical direction V (e.g., as illustrated, vertically downward and horizontally outward away from the additive receiver chamber 202), such that the stream of additive 240 from the dispensing tube 210 generally drains entirely, e.g., such that residual additive is not retained in the dispensing tube 210 outside of the additive receiver chamber 202, to prevent or minimize freezing additive in the end of the dispensing tube 210 which is outside of the additive receiver chamber 202. In some embodiments, a thermally conductive element, e.g., a piece of metal or other material with similar high thermal conductivity, may extend from the heater 276 to the end portion of the dispensing tube 210 to warm the end portion of the dispensing tube 210 and reduce or prevent freezing of additive therein. In addition, at least the end portion of the dispensing tube 210 itself may be metal or other similar high thermal conductivity material (such as the entire dispensing tube 210 may include a metal material and the heater 276 may be in contact with the metal dispensing tube 210). In some embodiments, the end portion of the dispensing tube 210 may have an enlarged diameter relative to the rest of the dispensing tube 210 to prevent or reduce liquid additive remaining in the end portion of the dispensing tube 210 after a dosing operation.

Also illustrated in FIG. 6 are a stream of additive 240 emanating from an outlet 216 of the dispensing tube 210 and a stream of water 250 emanating from the water fill tube 222. The stream of additive 240 and the stream of water 250 may mix in a trough 274, forming a mixture 260 of water and additive. Accordingly, the mold body 220, e.g., the one or more mold cavities 226 therein, may be positioned downstream of the dispensing tube 210 and downstream of the fill tube 222, such as downstream of the mixing trough 274 which receives the flow of additive 240 from the dispensing tube 210 and the flow of liquid water 250 from the fill tube 222. The mold cavity 226 may be configured for receiving the mixture 260 of liquid water and liquid additive, e.g., from the mixing trough 274. The mold cavity 226 may be further configured for retaining the mixture 260 of liquid water and liquid additive to form an ice piece from the mixture 260 in the mold cavity.

Figure 7:
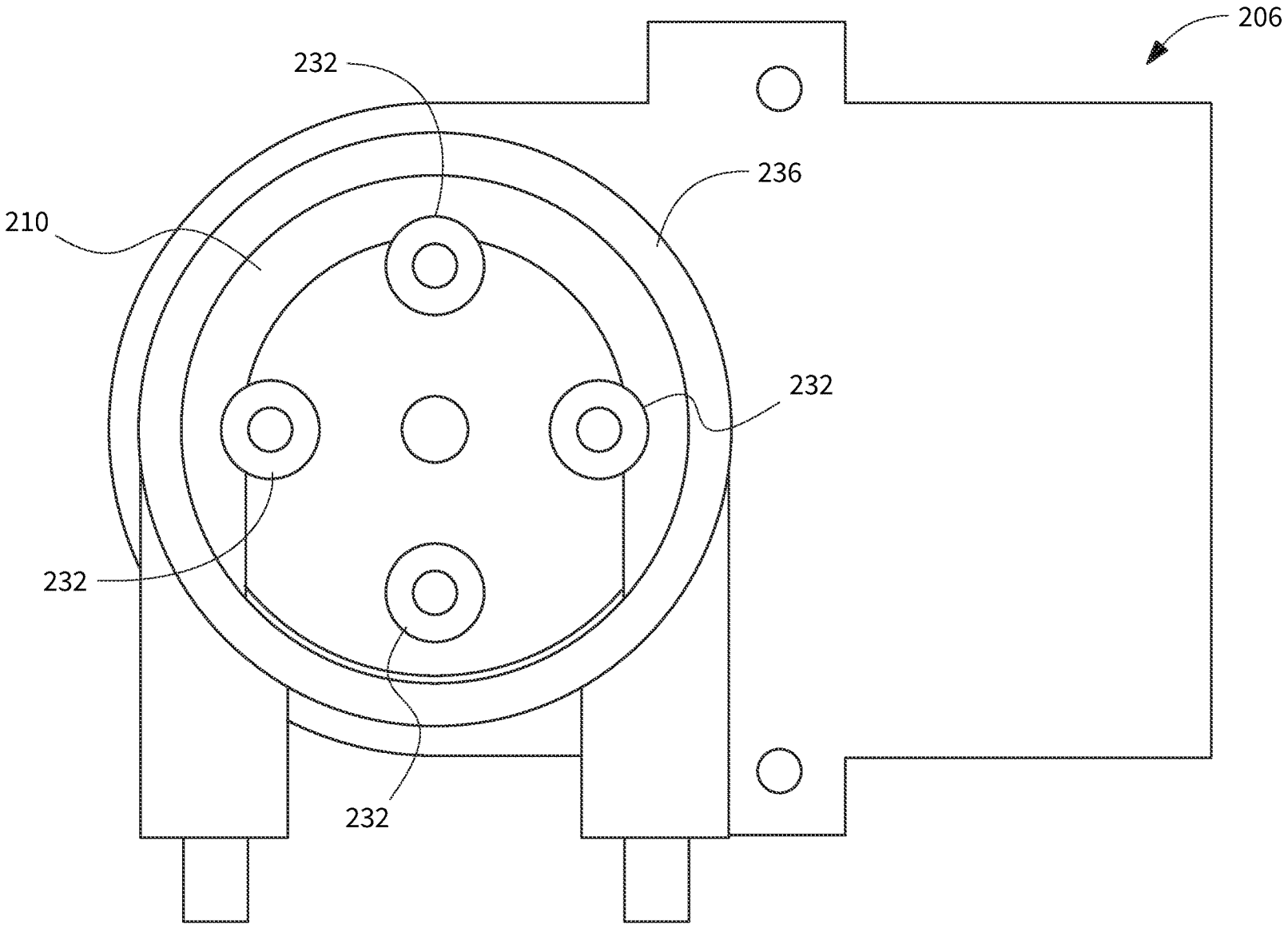
FIG. 7 provides a front elevation view of an exemplary dosing pump for an ice making assembly such as the exemplary ice making assembly of FIG. 4.
Figure 8:
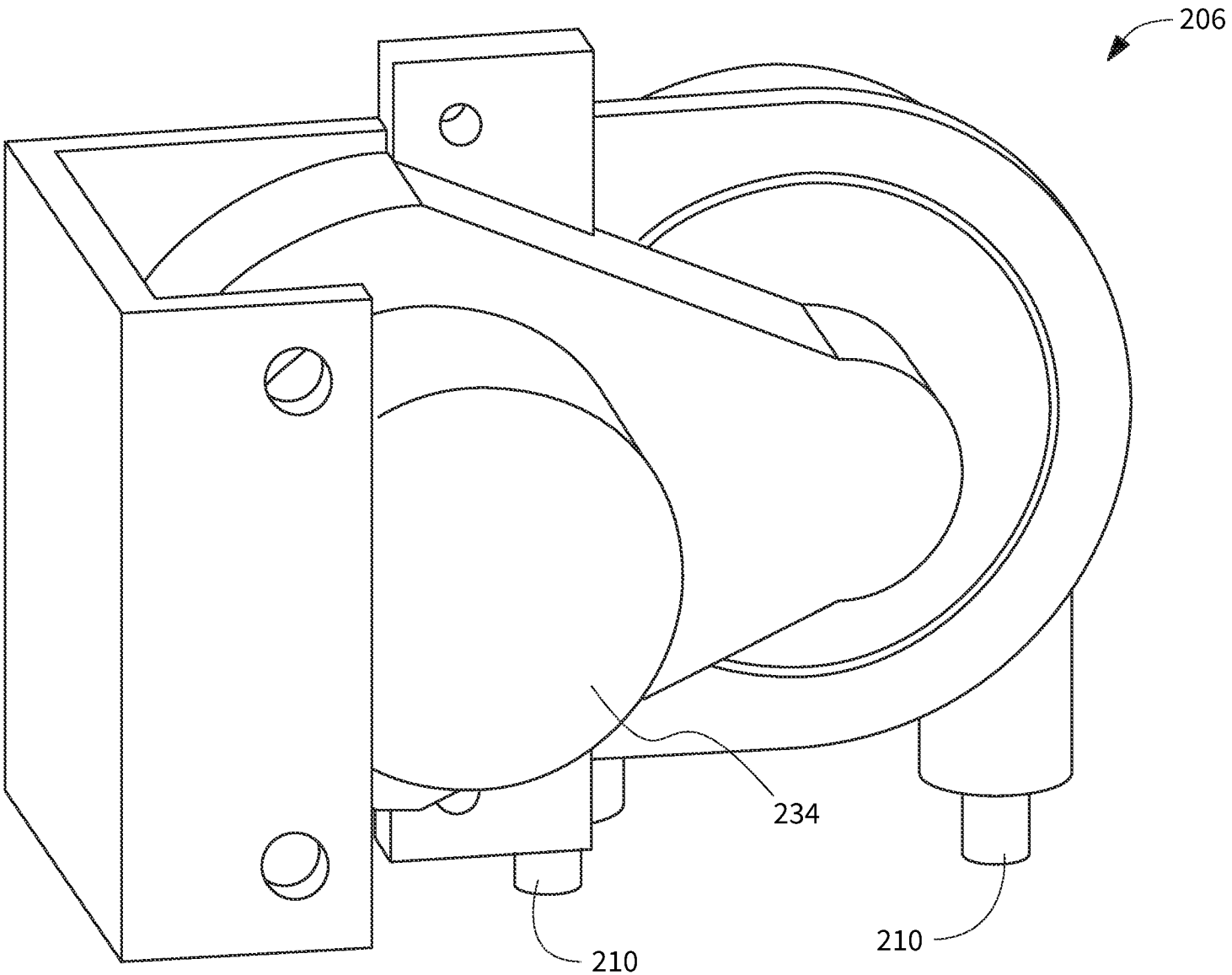
FIG. 8 provides a rear perspective view of the exemplary dosing pump of FIG. 8.

Referring now to FIGS. 7 and 8, in some embodiments, the dosing pump 206 may be a peristaltic pump. For example, a segment of the dispensing tube 210 may extend through a housing 236 of the peristaltic pump 206, and the peristaltic pump 206 may include a plurality of rollers 232, each of which compresses a portion of the dispensing tube 210 between the roller 232 and the housing 236. The peristaltic pump 206 may further include a motor 234 (FIG. 8), such as a stepper motor, which is operable to rotate the rollers 232 within the housing 236 such that the rollers 232 progressively and sequentially compress portions of the dispensing tube 210, thereby urging the additive from the additive cup 204 through the dispensing tube 210 and to the mold body 220.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker appliance, comprising:
- an additive receiver chamber comprising a plurality of chamber walls and an enclosed internal volume defined within the plurality of chamber walls;
- an additive cup positioned within the additive receiver chamber, the additive cup configured to receive a volume of liquid additive;
- a dispensing tube coupled to the additive cup and extending partially within the additive receiver chamber;
- a fill tube in fluid communication with a water supply; and
- a mold body comprising a mold cavity, the mold body positioned downstream of the dispensing tube and the fill tube, the mold cavity configured for receiving a mixture of liquid water from the fill tube and liquid additive from the additive cup through the dispensing tube, the mold cavity further configured for retaining the mixture of liquid water and liquid additive to form an ice piece from the mixture in the mold cavity.

2. The ice maker appliance of claim 1, further comprising a heater in the additive receiver chamber.

3. The ice maker appliance of claim 1, further comprising a dosing pump positioned within the additive receiver chamber.

4. The ice maker appliance of claim 3, wherein the dosing pump is a peristaltic pump.

5. The ice maker appliance of claim 1, wherein an end portion of the dispensing tube extends outside of the additive receiver chamber, and wherein the end portion of the dispensing tube is oriented vertically downwards.

6. The ice maker appliance of claim 1, wherein the plurality of chamber walls comprise a thermal insulation material.

7. The ice maker appliance of claim 1, further comprising a temperature sensor in the additive receiver chamber.

8. The ice maker appliance of claim 1, wherein the liquid additive comprises one or more of flavorant, electrolytes, or vitamins.

9. A refrigerator appliance, comprising:
- a cabinet;
- a chilled chamber defined within the cabinet; and
- an ice making assembly positioned in the chilled chamber, the ice making assembly comprising:
  - an additive receiver chamber comprising a plurality of chamber walls and an enclosed internal volume defined within the plurality of chamber walls;
  - an additive cup positioned within the additive receiver chamber, the additive cup configured to receive a volume of liquid additive;
  - a dispensing tube coupled to the additive cup and extending partially within the additive receiver chamber;
  - a fill tube in fluid communication with a water supply; and
  - a mold body comprising a mold cavity, the mold body positioned downstream of the dispensing tube and the fill tube, the mold cavity configured for receiving a mixture of liquid water from the fill tube and liquid additive from the additive cup through the dispensing tube, the mold cavity further configured for retaining the mixture of liquid water and liquid additive to form an ice piece from the mixture in the mold cavity.

10. The refrigerator appliance of claim 9, further comprising a heater in the additive receiver chamber.

11. The refrigerator appliance of claim 9, wherein the chilled chamber is a freezer chamber.

12. The refrigerator appliance of claim 9, further comprising a dosing pump positioned within the additive receiver chamber.

13. The refrigerator appliance of claim 12, wherein the dosing pump is a peristaltic pump.

14. The refrigerator appliance of claim 9, wherein an outlet end of the dispensing tube extends outside of the additive receiver chamber, and wherein the outlet end of the dispensing tube is oriented vertically downwards.

15. The refrigerator appliance of claim 9, wherein the plurality of chamber walls comprise a thermal insulation material.

16. The refrigerator appliance of claim 9, further comprising a temperature sensor in the additive receiver chamber.

17. The refrigerator appliance of claim 9, wherein the ice making assembly is an auxiliary ice making assembly, further comprising a primary ice making assembly separate from the auxiliary ice making assembly.

18. The refrigerator appliance of claim 9, wherein the liquid additive comprises one or more of flavorant, electrolytes, or vitamins.

* * * * *